US006481884B1

(12) United States Patent
Wetherington

(10) Patent No.: US 6,481,884 B1
(45) Date of Patent: Nov. 19, 2002

(54) APPARATUS AND METHOD FOR MIXING A DRY CHEMICAL CONTAINED WITHIN A CONTAINER

(76) Inventor: William S. Wetherington, 2506 Steeplechase, New Bern, NC (US) 28560

( * ) Notice: Subject to any disclaimer, the term of this patent is extended or adjusted under 35 U.S.C. 154(b) by 0 days.

(21) Appl. No.: 09/665,877

(22) Filed: Sep. 20, 2000

(51) Int. Cl.[7] ..... B01F 5/02; B01F 15/02

(52) U.S. Cl. ..... 366/136; 366/173.1; 366/181.1

(58) Field of Search ..... 366/136, 137, 366/152.1, 152.4, 160.1, 160.2, 167.1, 168.1, 173.1, 173.2, 181.1–181.3, 190; 137/563; 239/103, 120–122

(56) References Cited

U.S. PATENT DOCUMENTS 1,020,937 A * 3/1912 Warwick
1,544,922 A * 7/1925 Midgley, Jr.
1,989,013 A * 1/1935 Levene
4,045,004 A * 8/1977 Berger
4,081,006 A * 3/1978 Crowell et al.
4,103,358 A * 7/1978 Gacki et al.
4,474,476 A * 10/1984 Thomsen
4,699,188 A * 10/1987 Baker et al.
4,820,053 A * 4/1989 Rivers
4,941,131 A * 7/1990 Daly et al.
4,955,723 A * 9/1990 Schneider
5,211,475 A * 5/1993 McDermott
5,314,123 A * 5/1994 Miller
5,609,417 A * 3/1997 Otte
5,688,046 A * 11/1997 Triassi et al.
5,875,969 A * 3/1999 Grundy
6,247,838 B1 * 6/2001 Pozniak et al.

FOREIGN PATENT DOCUMENTS

DE 3241470 * 12/1983

* cited by examiner

*Primary Examiner*—Charles E. Cooley
(74) *Attorney, Agent, or Firm*—Coats & Bennett, P.L.L.C.

(57) ABSTRACT

An apparatus and method for mixing a dry chemical contained within a container. A probe is utilized to puncture an opening in the container and thereafter the probe is extended through the opening. A mixture or liquid is directed to and through the probe and, as the liquid or mixture exits the probe, the dry chemical is dissolved and mixed with the liquid or mixture. Thereafter, the resulting mixture gravitates downwardly through the opening in the container to an underlying tank. Associated with the tank is a concentration controller that is operatively connected to a pump that pumps the mixture from the tank to and through the probe. Effectively, the concentration controller periodically activates the pump so as to maintain the concentration level of the mixture in the tank within a pre-selected range.

9 Claims, 5 Drawing Sheets

APPARATUS AND METHOD FOR MIXING A DRY CHEMICAL CONTAINED WITHIN A CONTAINER

FIELD OF THE INVENTION

The present invention relates to systems and processes for mixing chemicals and, more particularly, to a system and process for mixing a chemical in a container with a liquid.

BACKGROUND OF THE INVENTION

Many chemicals are packaged in containers such as buckets. These chemicals come in various forms, particularly dry and liquid forms. Dry chemicals can assume the form of a dry powder, granules, briquettes, tablets, flakes, etc. However, handling and managing dry-form chemicals can be problematic. One of the problems that arises in handling and mixing dry-form chemicals is that it is difficult in some cases to manage and confine the chemical as it is being transferred from the container to a mixer or mixing tank, for example. Often this transfer and mixing may occur in an outside environment where there is wind and other undesirable weather elements. In the case of a dry-form chemical, especially those chemicals that are presented in a dry powder form, one finds that in transferring the chemical from the container to a mixing tank, for example, that much of the chemical ends up being deposited in the environment around the container and the mixing tank.

It is common practice to utilize chemicals such as potassium permanganate in wastewater and potable water treatment processes. Potassium permanganate is normally produced in a dry powder form and containerized in a container such as a 5-gallon bucket. Periodically, personnel at the water or wastewater treatment facility will mix the dry potassium permanganate powder with a liquid in a tank. In transferring the dry powder to the tank, it is not uncommon for the fine granules of powder to end up outside both the container and the mixing tank. Often this is in the form of a fine dust. In any event, the end result is that the potassium permanganate ends up on the worker's clothes and on system elements outside the mixing tank and the container and, in the final analysis, is simply downright messy.

Therefore, there is, and continues to be, a need for a system and process for mixing chemicals, especially chemicals that come in a dry powder form, that avoids the aforementioned problems.

SUMMARY OF THE INVENTION

The present invention entails a system and process for mixing a chemical within a container with a liquid by directing a liquid or mixture into the container itself and mixing the liquid or mixture with the chemical within the confines of the container and then directing the resulting mixture from the container to a holding tank.

In another embodiment of the present invention, the chemical may be held within a holding area as opposed to being held within a conventional container. Here the present invention entails directing a liquid into the holding area where the chemical is held and effectively removing the chemical as a result of the liquid or mixture coming into contact with the chemical within the holding area.

More particularly, the present invention entails a probe that is extended into the container containing the chemical. Liquid under pressure is directed to, through, and out the probe. As the liquid is expelled from the probe, under pressure, the liquid causes a portion of the chemical contained within the container to be directed from the container into a holding tank. In one embodiment, the probe is anchored above an opening within the tank and there is provided a supporting structure for holding the container over the probe after the probe has punctured an opening in the container. There the resulting mixture is allowed to gravitate through the opening formed by the puncture into the underlying tank. In another embodiment, the probe is directed into a holding area where the chemical is held or allowed to accumulate. Here the probe extends into the holding area where the chemical is held and a liquid or mixture is expelled from the probe and causes the surrounding chemical to be removed from the holding area. Again, typically the chemical is allowed to gravitate into a mixing tank where the chemical is mixed with a liquid or mixture within the mixing tank.

In one embodiment, the system is provided with a recirculating and mixing pump. In particular, the pump is operative to circulate the mixture from the tank to and through the probe. To control the concentration of the mixture within the tank within a pre-selected range, a concentration controller is provided and is operatively coupled to the recirculation and mixing pump. Once the measured concentration of the mixture falls below a pre-selected range, the concentration controller is operative to actuate the pump, causing the pump to pull portions of the mixture from the tank and direct the same through the probe and into the container, mixing with the chemical therein, which results in the mixture formed in the container being directed back to the tank. This has the effect of increasing the concentration of the mixture within the tank.

The probe which is inserted into the container includes an inlet and, in one embodiment, a series of outlet or jet ports. These outlet ports are arranged about the probe to efficiently direct a liquid or mixture under pressure into the surrounding chemical. In one particular embodiment, the probe includes at least one vertical cavity formed in the probe with an outlet port disposed about an upper end portion thereof and directed generally downwardly. This outlet port tends to direct a jet of liquid downwardly toward the opening formed within the container and effectively keeps that general area open and unclogged such that the resulting mixture can freely gravitate from the container through the opening formed therein.

Other objects and advantages of the present invention will become apparent and obvious from a study of the following description and the accompanying drawings which are merely illustrative of such invention.

DETAILED DESCRIPTION OF THE INVENTION

With further reference to the drawings, the chemical mixing system of the present invention is shown therein and indicated generally by the numeral 10. As will be appreciated from subsequent portions of this disclosure, the chemical mixing system 10 is designed to receive and hold a container, indicated generally by the numeral 12, that contains a chemical therein. While the texture and form of the chemical may vary, the chemical mixing system 10 of the present invention is particularly adapted to handle a mix of chemicals in a dry form, such as powder, flakes, briquettes, sticks, tablets, etc.

Figure 1:
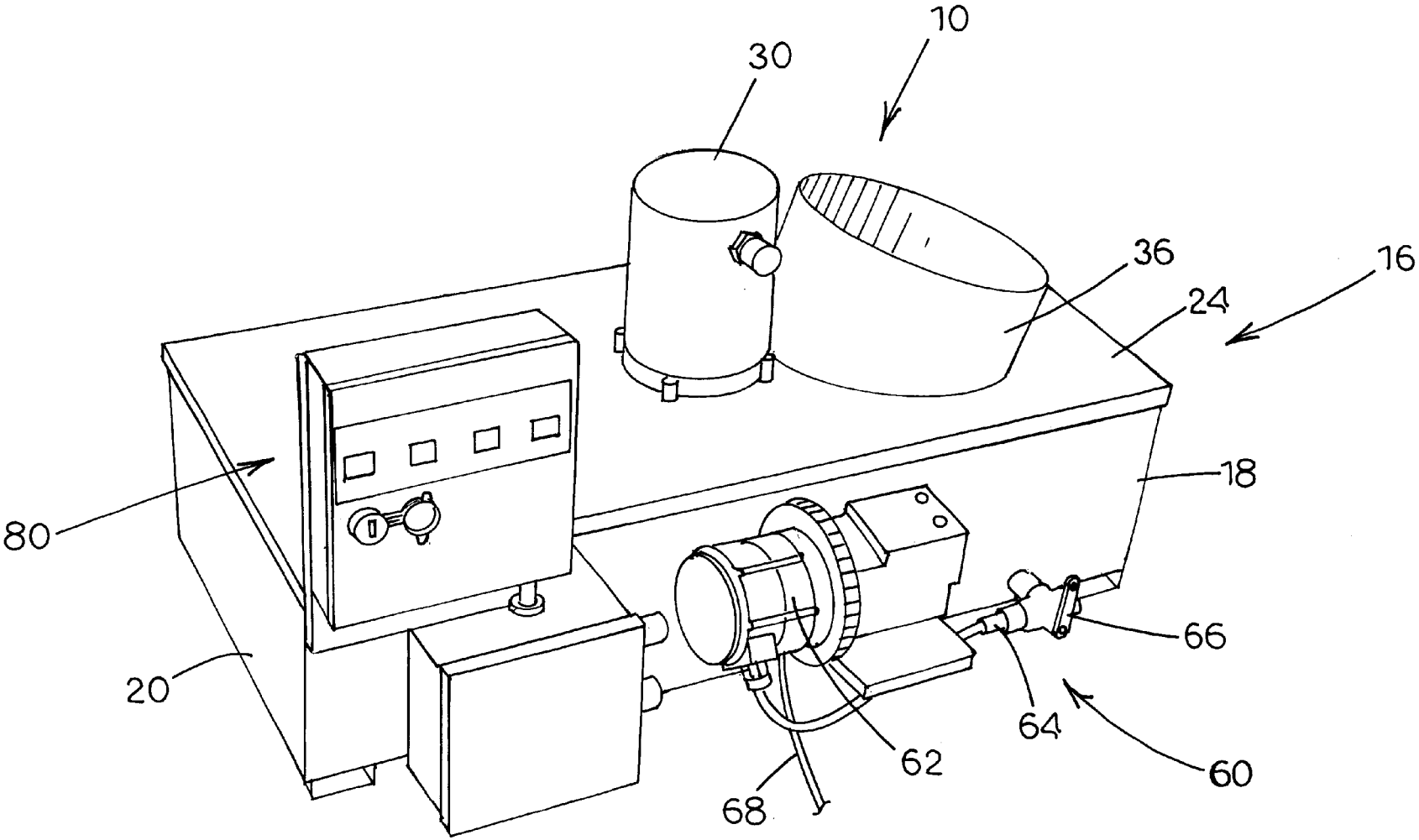
FIG. 1 is a perspective view of the chemical mixing system of the present invention shown from one side.
Figure 2:
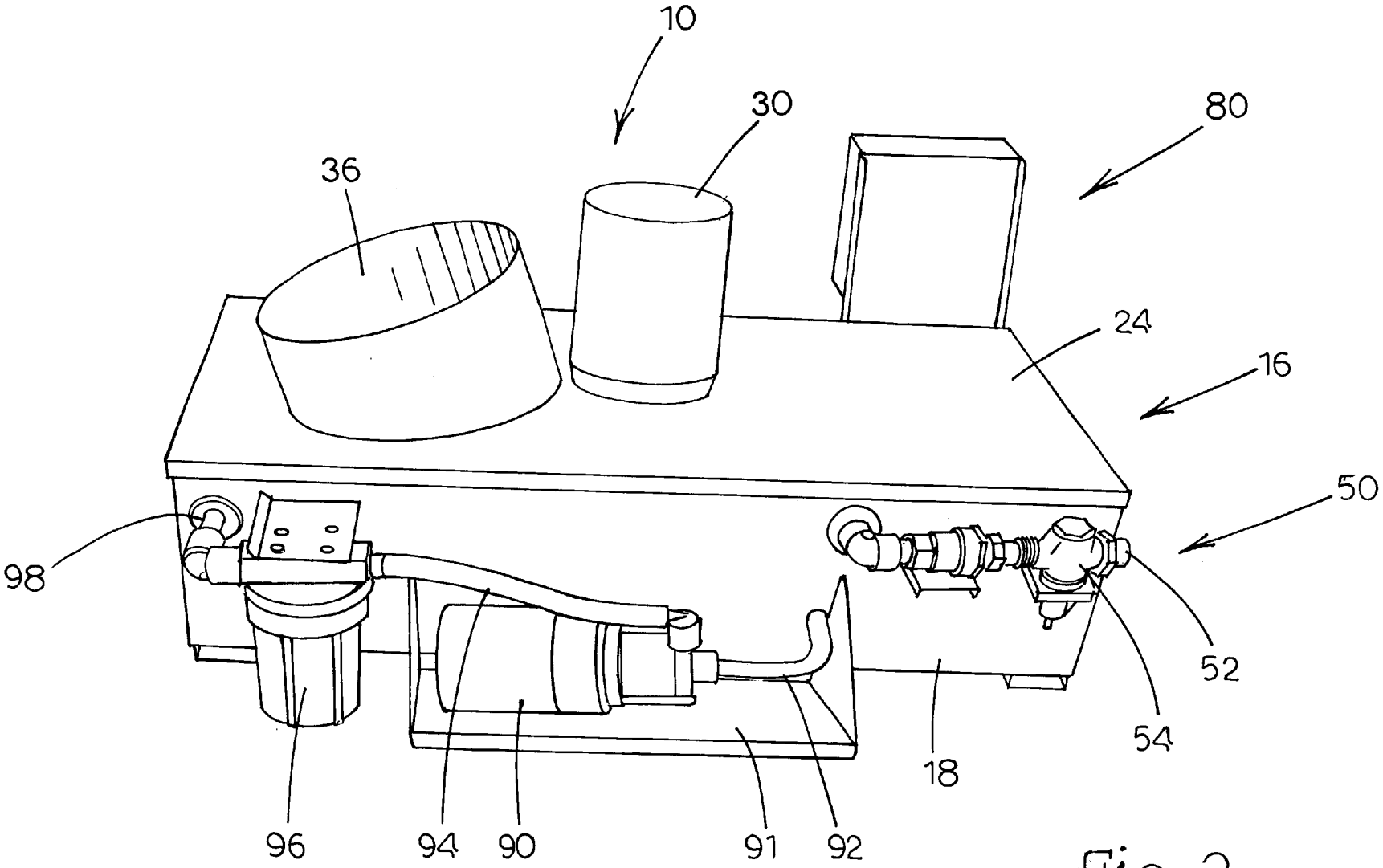
FIG. 2 is a perspective view of the chemical mixing system shown from the opposite side.
Figure 3:
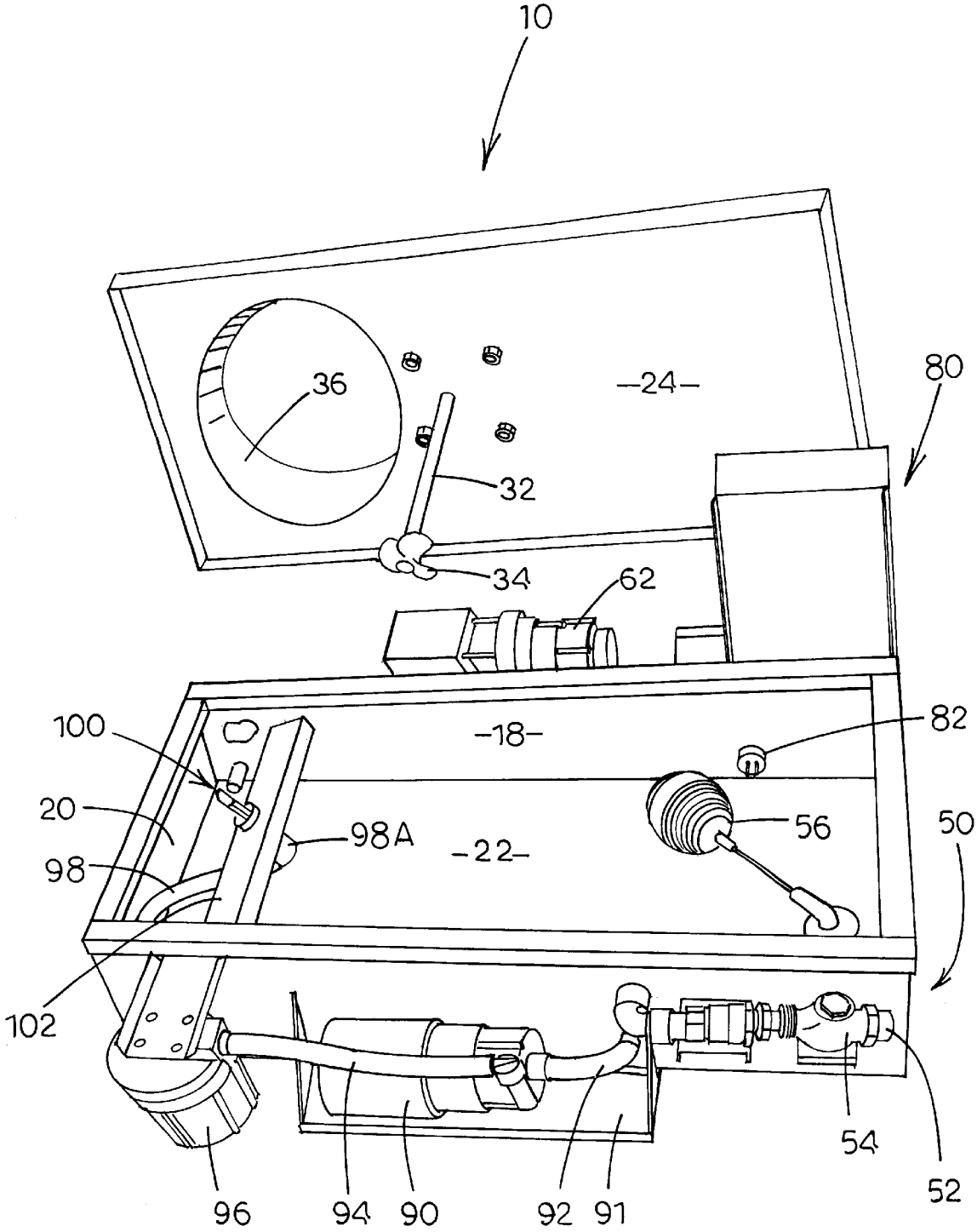
FIG. 3 is a perspective view of the chemical mixing system with the top removed.

Viewing the chemical mixing system 10 in more detail, and with particular reference to FIGS. 1–3, the mixing system includes a mixing tank indicated generally by the numeral 16. Mixing tank 16 includes a pair of opposed sides 18, a pair of ends 20, a bottom 22, and a removable top 24. The tank 16 can be constructed of various materials, such as metal, plastic, or any other suitable material.

Mounted to the top 24 of tank 16 is a mixer 30. Mixer 30 is preferably an electric mixer that includes a shaft extending downwardly through the top 24. About the terminal end of shaft 32 is a propeller 34.

Figure 4:
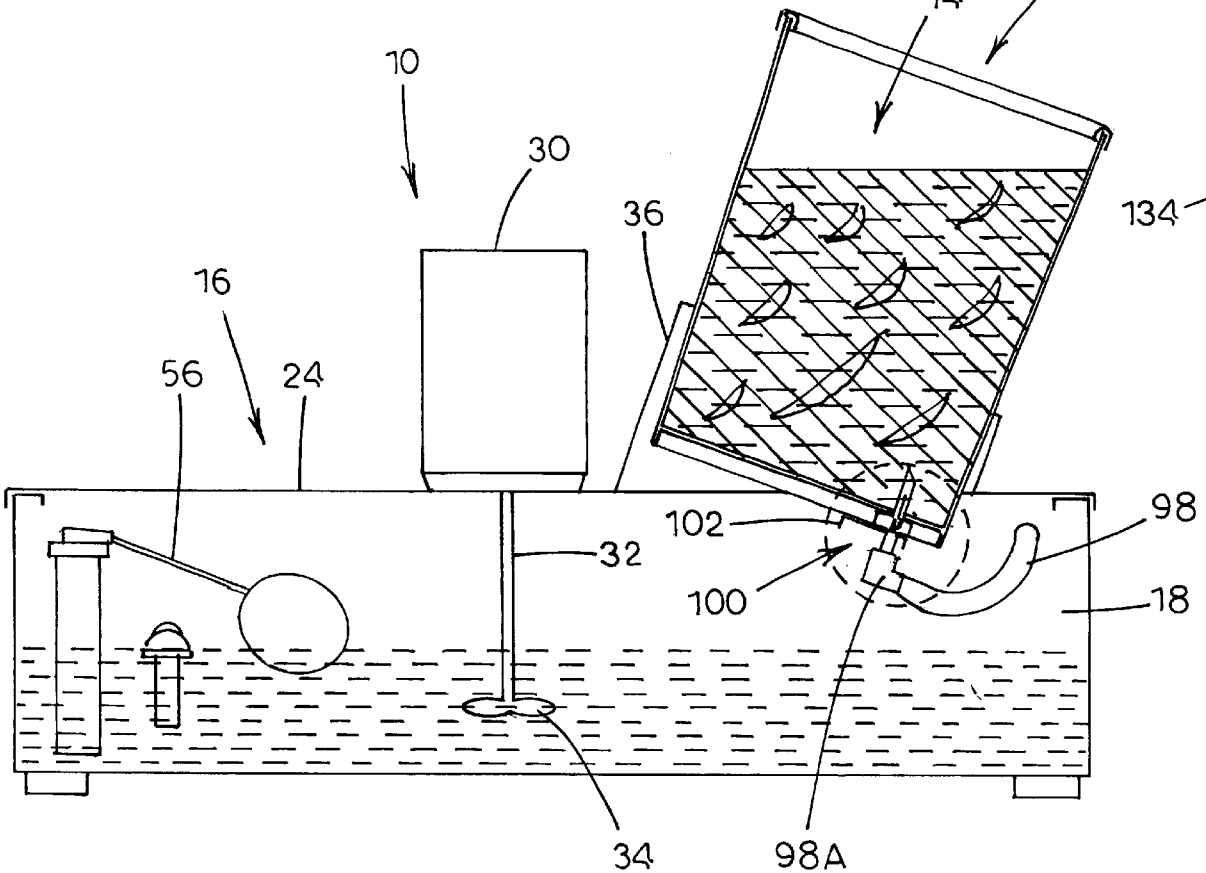
FIG. 4 is a side diagrammatic view illustrating a container containing a chemical supported on the chemical mixing system.
Figure 9:
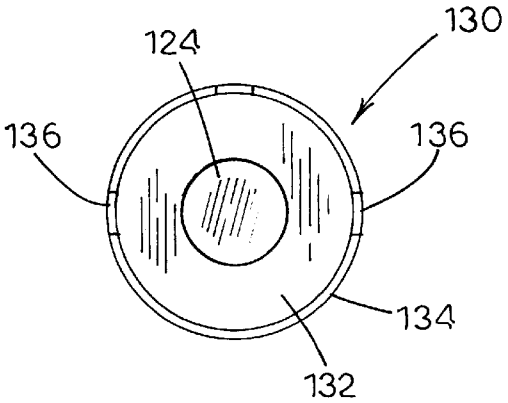
FIG. 9 is a top plan view of the probe.
Figure 10:
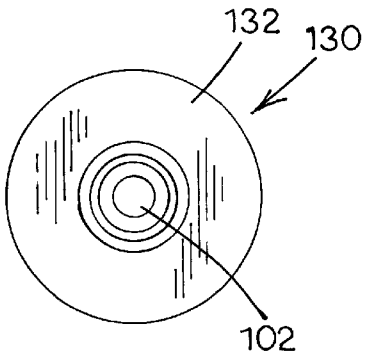
FIG. 10 is a bottom plan view of the probe.

Adjacent the mixer 30, there is provided an opening in the top 24 of the tank 16. The purpose of the opening is to receive and accommodate the container 12. As particularly seen in FIGS. 1–3, the opening formed in the top 24 to accommodate the container includes an inclined band 36 that surrounds the opening. As seen in FIG. 4, the inclined band forms a receiving opening that is particularly sized for the container 12. Because of the inclination of the sidewalls that form the inclined band 36, it is seen in FIG. 4 that the entire container 12 is held and confined at an angle with respect to the top 24 of the tank 16.

The mixing tank 10 is provided with a liquid inlet control assembly that is indicated generally by the numeral 50. The liquid inlet control assembly 50 includes an inlet 52 that is adapted to be connected to a fluid source, such as a source of water. Operatively associated with the inlet 52 is a control valve 54 for controlling the flow of the fluid source, or water, into the inlet 52. To actuate and control the control valve 54 there is provided, as illustrated in FIG. 3, a float switch 56. The float switch 56 can be adjusted to actuate the control valve 54 as the fluid level within the tank 16 fluctuates. That is, the float switch 56 is preferably adjusted to maintain a certain level of liquid within the tank 16. When the level of liquid within the tank 16 falls below a predetermined level, the float switch 56 will actuate the control valve 54 causing the fluid source, such as water, to be directed into the inlet 52, through the control valve 54, and through associated piping and into the tank.

As will be appreciated from such subsequent portions of this disclosure, the chemical mixing system is adapted to produce a mixture that comprises a chemical contained within the container 12 and a liquid. This mixture is contained within tank 16 and continuously or periodically discharged from the tank.

To accommodate discharge, the chemical mixing system 10 is provided with a discharging system indicated generally by the numeral 60. As particularly seen in FIG. 1, the discharge system 60 includes a discharge pump 62 that is connected to an inlet line 64, that extends from a control valve 66 to the discharge pump 62. It is appreciated that control valve 66 is communicably connected to the interior of the tank 16 such that the mixture contained therein can flow from the tank through the control valve 66 and to the discharge pump 62. Further, there is provided a discharge line 68 that leads from the discharge pump 62. The discharge pump 62 can be controlled in conventional fashion to discharge a certain flow rate of mixture from the tank continuously, from time-to-time, or in accordance with a pre-programmed scheduled.

It is desirable to control the concentration of the mixture within the tank 16. More particularly, the concentration of the chemical that forms a part of the mixture would be controlled. To achieve this, the chemical mixing system 10 of the present invention includes a concentration controller indicated generally by the numeral 80. The concentration controller 80 functions to maintain the concentration of the chemical at a certain level, or above a certain level, or within a pre-selected concentration range. Effectively, the concentration controller 80 senses and measures the concentration of the chemical within the mixture. Details of the concentration controller 80 are not dealt with herein because such is not, per se, material to the present invention and, further, because concentration controllers are well known in the art and indeed are commercially available. Briefly, however, it should be pointed out that many concentration controllers will effectively measure a property such as the conductivity of the mixture and, based on the conductivity, the concentration controller will be able to determine the concentration of a particular chemical or chemicals within a mixture.

As will be appreciated from subsequent discussions by the foregoing, this pumping system is designed to circulate the mixture from the tank into the container 12 where the mixture mixes with the chemical 14 therein. This mixture formed within the container then flows or gravitates from the container 12 back into the tank 16.

Turning to the pumping system for circulating the mixture to the container 12, it is seen that the same includes a pump 90 secured on a support 91 adjacent one side of the tank 16. An inlet line 92 is operatively interconnected between the tank 16 and an inlet associated with the pump 90. An outlet line 94 leads from the pump 90 to a filter 96. Extending from the filter 96 is feedline 98 that extends through an opening formed in the sidewall 18 of the tank. As illustrated in FIG. 3, the feed line 98 extends inwardly into the tank 16 and includes a coupler 98A secured on the remote end thereof. Coupler 98A is connected to a probe, indicated generally by the numeral 100. Probe 100 is supported on a cross-bar 102 that is secured between opposed sides 18 of the tank 16.

Pump 90 is operative to pump the mixture from the tank 16 through the inlet line 92 into the pump. The mixture is then pumped through outlet line 94 into the filter 96 and after passing through the filter the mixture is directed through the feed line 98 into the probe 100. As will be appreciated from the subsequent portions of this disclosure, the probe 100 is operative to dispense the mixture, preferably in a jet form, into the container 12 which, according to the present invention, is supported by the incline band 36 and cross bar 102 and over the probe 100.

Turning to FIGS. 6–9, the probe 100 is shown therein. Formed on one end of the probe 100 is an inlet 107. Communicatively connected to the inlet 107 is an internal bore or manifold 104. In the case of the design shown in FIGS. 6–8, the manifold or internal bore 104 extends axially through the probe 100.

Figure 6:
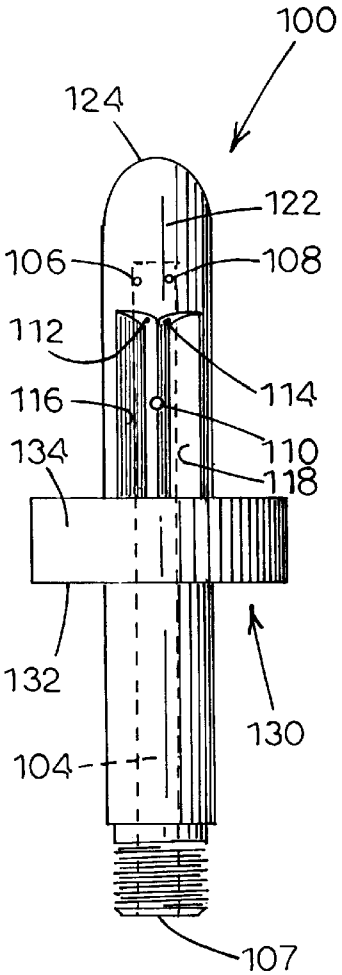
FIG. 6 is a side elevational view of one side of the probe that forms a part of the chemical mixing system of the present invention.

Probe 100 is provided with a series of outlet ports that are communicatively connected to the internal bore or manifold 104. It should be noted, that the number and positioning of the outlet ports can vary. However, in the case of the embodiment illustrated herein, there is provided three (3) horizontally disposed outlet ports 106, 108, and 110. Further, there is provided two (2) vertically directed ports, 112 and 114. Further, about the side of the probe 100 shown in FIG. 1, there is provided a pair of vertical cavities 116 and 118. These vertical cavities 116 and 118 are cut or milled into the probe 100 and in the case of the embodiment shown in FIG. 6 extend generally downwardly from the vertical oriented or directed ports 112 and 114. Disposed on the side of the probe opposite of that shown in FIG. 6 is one (1) additional horizontal directed port 120. This is illustrated in FIG. 8.

Figure 8:
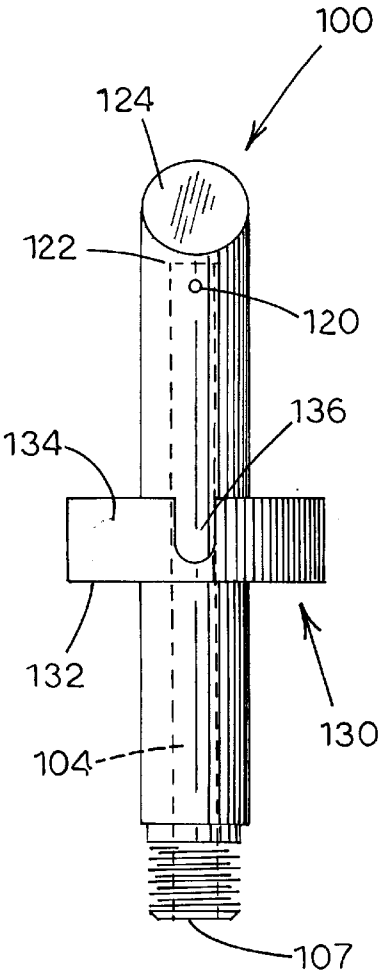
FIG. 8 is still another side view of the probe.
Figure 7:
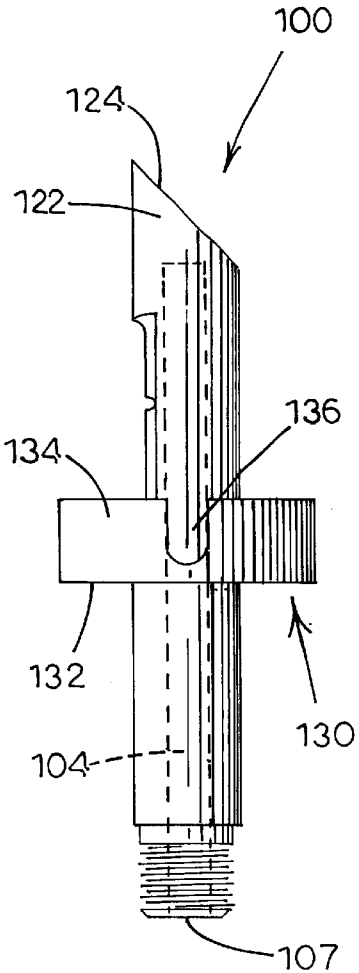
FIG. 7 is another side view of the probe.

As seen in FIGS. 6–8, the probe 100 assumes a generally cylindrical configuration and includes an outer cylindrical surface 122. Formed about the top portion of the probe 100 is a tapered or beveled tip 124. The tapered tip 124 functions to puncture an opening in the container 12 when the container is placed on the probe 100. More particularly, the bottom of container 12 is punctured by the beveled tip 124 as the container is dropped into the opening defined by the incline band 36.

Disposed intermediately on the probe 100 is a base 130. Functionally, the base 130 serves to form a seal or retainer for preventing the chemical in the form of a dry powder from continuously falling through the punctured opening of the container 12 during the period when the probe 100 is inactive. Secondly, the base 130 functions to permit the mixture generated within the container 12 to gravitate or drain downwardly therethrough during periods when the probe is active. As seen in FIGS. 6-9, the base 130 includes a surrounding trough structure that includes a bottom 132 and a surrounding wall 134. Formed in the surrounding sidewall 134 is at least one (1) drain cut out 136.

With particular reference to FIG. 4, note that once the probe 100 punctures an opening in the bottom of the container 12, that the probe extends upwardly through the bottom into the container 12. As noted, the present invention contemplates that the chemical contained within the container 12 would in many instances assume a dry powder form. In such cases, when the probe 100 is inactive or inoperative, meaning that it is not expelling mixture therefrom, the dry chemical will effectively surround the probe 100. Moreover, the dry chemical will actually gravitate downwardly along the probe and accumulate in the base 130, and more particularly in the surrounding trough defined by the bottom 132 and surrounding sidewall 134. The accumulation of the dry powder will effectively seal the punctured opening formed in the bottom of the container 12 by the probe 100.

When the concentration controller 80 calls for an increase in the concentration of the mixture held within the tank, concentration controller 80 will actuate the pumping system for circulating the mixture from the tank into the container 12. Specifically, the concentration controller 80 will actuate pump 90 and the pump 90 will direct mixture from the tank into the inlet 107 of the probe 100. The mixture will move upwardly through the internal bore 104 and be expelled through the various outlet ports 106, 108, 110, 112, 114 and 120 formed in the probe 100. Note that the ports 112 and 114 are disposed about the upper portion of the cavities 116 and 118. These two ports are directed generally downwardly towards the base 130. The mixture expelled from ports 112 and 114 tends to mix with and dissolve the underlying chemical and generally prevents the area around the probe 100 from becoming clogged. Essentially, the mixture expelled from all of these ports mixes with the surrounding chemical and this resulting mixture drains downwardly through the punctured opening in the bottom of the container 12, and out the drain cut-outs 136 formed in the sidewall 134 of the surrounding trough.

Figure 5:
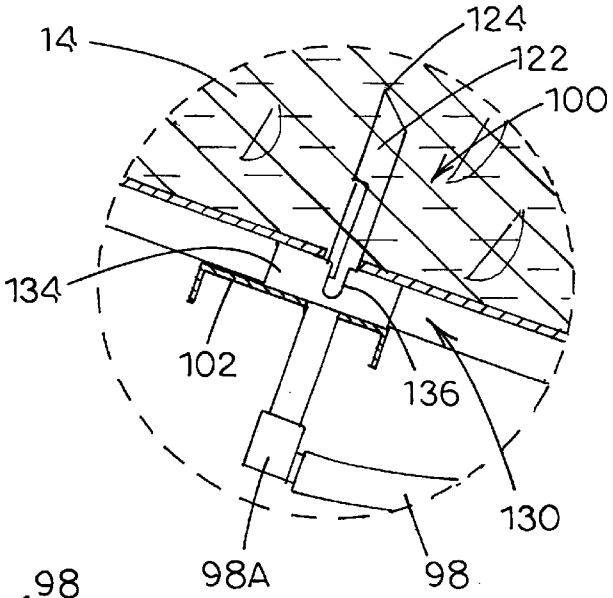
FIG. 5 is a detailed view of the encircled structure shown in FIG. 4.

The chemical mixing system 10 of the present invention can be used in a variety of applications. One such application deals with a waste water treatment system where potassium permanganate and is mixed and dispensed into the waste water system continuously or on a periodic basis. The potassium permanganate is particularly effective in controlling hydrasulfide gas. In such a case, potassium permanganate is presented in a dry-powdered form and containerized within the container 12. The container is loaded into the chemical mixing system by placing the container within the opening defined by the incline band 36. Once the container is dropped into place, the tapered tip 124 punctures the bottom of the container 12 forming an opening therein, allowing the probe to extend upwardly through the opening. Note in FIG. 5 where the cross-bar 102 effectively supports the bottom of the container 12, while the incline band 36 generally confines and stations the container 12 about the opening overlying the tank 16.

As discussed above, the mixture held within the tank is periodically or from time to time directed into the probe where the mixture is expelled and mixes with the potassium permanganate contained within the container 12. The resulting mixture gravitates downwardly through the punctured opening in the bottom of the container and out the drain slots 136 formed in the surrounding wall 134 that forms a part of the base 130. This resulting mixture simply drains down into the tank where it is held. The mixture held within the tank is dispersed from the tank by the discharge system 60. In the case of using potassium permanganate to treat waste water, the discharge system is timed or programmed to dispense a certain amount of the potassium permanganate mixture from the tank 16 into the waste water treatment system. The volume and concentration of the potassium permanganate can be varied to accommodate the size and needs of the particular waste water being treated.

In the above discussions, it is appreciated that the liquid or mixture expelled from the probe 100, causes the chemical contained within the container to be directed from the container into the mixing tank. In some instances, it has been noted that the liquid or mixture expelled from the probe mixes with the chemical within the container. It should be noted that the liquid or mixture expelled from the probe in many instances will not completely mix with the chemical within the confines of the container itself. Complete mixing in many instances will not occur until the chemical reaches the mixing tank and is subjected to mixing therein. Basically, the liquid or mixture expelled from the probe 100 acts as a carrier and effectively contacts the chemical within the container and carries the chemical from the container as described above.

Further, it should be appreciated that the present invention is not simply confined to dealing with a chemical within a conventional container. Specifically, the present invention and the manner of directing a dry powder chemical into the mixing tank is applicable to other environments besides a conventional container. For example, the dry powder chemical may be directed into a holding area and wherein the probe 100 is directed upwardly into the holding area where the chemical within the holding area effectively surrounds the probe. Here the probe can again be used to expel a liquid or a mixture and cause the surrounding chemical to be transferred from the holding area to the mixing tank via an opening through which the probe extends. In addition, the probe can be extended into a pipe or hopper that continuously receives a supply of chemical and the same process as outlined above can be applied. In short, the present invention is workable not only with conventional containers such as buckets, but is also workable where the chemical is held within a holding area.

Further, the term dry chemical has been used here in. The term dry chemical simply means that the chemical is in a dry or liquid form such as powder or granules, as opposed to being in the form of a liquid.

From the foregoing specification and discussion, it is appreciated that the pre sent invention presents a very efficient and effective way of mixing chemicals within a container. It is particularly useful with respect to dry chemicals such as chemicals that assume the form of a dry powder. By actually mixing the chemical within the confines of the container and allowing the resulting mixture to drain from the container into an associated tank, chemical mixing operation is greatly simplified. Importantly, the chemical is confined and controlled and the problems associated with having to openly transfer the chemical from the container to a mixing tank are avoided.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A system for removing a dry chemical from a container comprising:

a probe for insertion into the container such that the probe projects through an opening in the container;

at least one jet port formed in the probe;

an inlet formed in the probe for receiving a liquid under pressure;

a liquid passageway formed in the probe, interconnecting the at least one jet port and the inlet such that when the probe assumes an active state, the liquid under pressure is expelled from the at least one jet port and mixes with the dry chemical in the container to form a liquid chemical mixture, and wherein when the probe assumes an inactive state the probe does not expel liquid therefrom; and means positioned adjacent the probe for: (1) prohibiting the flow of the dry chemical from the container through the opening surrounding the probe when the probe assumes an inactive state, and, (2) permitting the flow of the liquid chemical mixture from the container through the opening surrounding the probe when the probe assumes the active state.

2. The system of claim 1 wherein the means is secured to the probe and cooperates with the probe to generally prohibit the flow of dry chemical from the container when the probe assumes the inactive state.

3. The system of claim 2 wherein the dry chemical gravitates through the opening in the container and accumulates in the means when the probe assumes the inactive state.

4. The system of claim 3 wherein the means is adapted to receive and hold at least some dry chemical when the probe assumes the inactive state.

5. The system of claim 2 wherein the means comprises an annular trough with a surrounding side wall and bottom.

6. The system of claim 5 wherein the surrounding side wall of the annular trough includes at least one drain opening that permits the liquid chemical mixture to flow from the annular trough.

7. The system of claim 6 wherein the probe includes an insertion end for forming the opening in the container, and wherein the annular trough is secured to and extends around the probe.

8. The system of claim 7 wherein when the probe is inserted into the opening, the annular trough is disposed immediately adjacent the opening such that the annular trough is positioned to catch at least some of the dry chemical when the probe assumes the inactive state.

9. The system of claim 8 wherein when the probe is inserted through the opening, the surrounding side wall lies outwardly of the opening in the container.

* * * * *